United States Patent [19]

Cleusix

[11] Patent Number: 4,459,033

[45] Date of Patent: Jul. 10, 1984

[54] TIMEPIECE WITH IMPROVED PIVOTS FOR PIVOTABLE MEMBERS AND METHOD OF ASSEMBLY

[75] Inventor: Willy Cleusix, Le Landeron, Switzerland

[73] Assignee: Ebauches Electroniques S.A., Marin, Switzerland

[21] Appl. No.: 512,317

[22] Filed: Jul. 11, 1983

Related U.S. Application Data

[63] Continuation of Ser. No. 369,286, Apr. 16, 1982.

[30] Foreign Application Priority Data

Apr. 16, 1981 [CH] Switzerland ..... 2564/81

[51] Int. Cl.[3] ..... G04B 17/12

[52] U.S. Cl. ..... 368/185; 368/317; 368/318

[58] Field of Search ..... 368/28, 31, 32–38, 368/184, 185, 190–199, 316, 317, 318

[56] References Cited

U.S. PATENT DOCUMENTS 3,443,375 5/1969 Cielaszyk ..... 368/185
3,548,587 12/1970 Wood ..... 368/191 X
3,916,615 11/1975 Maeda ..... 368/191
4,143,507 3/1979 Ganter et al. ..... 368/34
4,262,354 4/1981 Sakamoto ..... 368/185

*Primary Examiner*—Bernard Roskoski
*Attorney, Agent, or Firm*—Pollock, Vande Sande & Priddy

[57] ABSTRACT

The various pivoting members—setting-lever (3), rocker lever (14) and correction lever (16)—of a setting mechanism having a setting stem (2) are held in place and pivoted by means of a metal bridge (90) an arm (9) of which forms the setting-lever spring. The setting-lever, the rocker lever and the correction lever are interposed between the plate (1, 10, 11) of the movement and the bridge which not only provides for holding them in position but also provides for pivoting thereof. For that purpose, these three pivoting members each carry an arbor (4, 15, 17), which is fitted thereto and which has two end sections (4*a,* 15*a,* 17*a;* 21) projecting outside of said pivoting member. One of these end sections (21) engages without appreciable clearance into a corresponding hole (101) in the bridge and the other end (4*a,* 15*a,* 17*a*) is located with substantial clearance in a corresponding hole (20) in the plate and serves for the prepositioning of said pivoting element on said plate.

8 Claims, 3 Drawing Figures

TIMEPIECE WITH IMPROVED PIVOTS FOR PIVOTABLE MEMBERS AND METHOD OF ASSEMBLY

This application is a continuation, of application Ser. No. 369,286, filed Apr. 16, 1982.

FIELD OF THE INVENTION

The present invention concerns timepieces with a setting mechanism comprising pivoting elements. Examples of pivoting elements are a setting-lever and a return bar or rocking lever. The invention concerns in particular timepieces having a plate which is at least partly made of plastics material and a method for assembling such timepieces.

BACKGROUND OF THE INVENTION

In such timepieces the position of the axis of rotation of each pivoting element relative to that of the other pivoting elements must be maintained with a great accuracy. Therefore, in the known timepieces (for example in that disclosed in Swiss Pat. No.: 130727), the pivoting elements are pivoted in the plate which is made of metal. However, in order to decrease the cost price of the timepiece it is desirable to employ a plate made at least partly of plastics material.

BRIEF SUMMARY OF THE INVENTION

Accordingly, one object of the present invention is to provide, for such timepieces, a simple and inexpensive means which is easy to assemble for pivoting and holding in position the pivoting members of the setting mechanism of a timepiece having a plate which is made at least partly of plastics material as, for example, a plate comprising a metal framework moulded into a plastics material.

According to the invention, there is provided a timepiece with setting mechanism, comprising: (a) a plate which is at least partly made of plastics material and has hollowed parts; and (b) pivoting members interposed between the plate and a bridge, and journalled in this bridge. Further each pivoting member has an part located with clearance in a respective one of said hollowed parts of the plate. These parts serve as means for pre-positioning the pivoting members on the plate.

According to a preferred embodiment, each pivoting member comprises an arbor member coaxially fitted on it and having two end sections projecting outside of said pivoting member. One of these end sections forms a pivot turning without appreciable clearance in a hole provided in the bridge, while the other end section is located in a hole of the plate and constitutes the above-mentioned pre-positioning means of the pivoting member.

BRIEF DESCRIPTION OF THE DRAWINGS

The invention will be described in more detail, by way of example, with reference to the accompanying drawings, in which.

DETAILED DESCRIPTION OF THE PREFERRED EMBODIMENT

The electronic watch illustrated comprises a movement plate 1 and a manually actuable, rotary and axially movable setting stem 2. The stem can occupy three stable axial positions and serves for setting the time shown by the watch, altering a date indicator (not shown) and for other functions which will not be described herein in detail. The mechanisms actuated by the setting device also will not be described in detail, as such mechanisms do not form part of the present invention.

Figure 1:
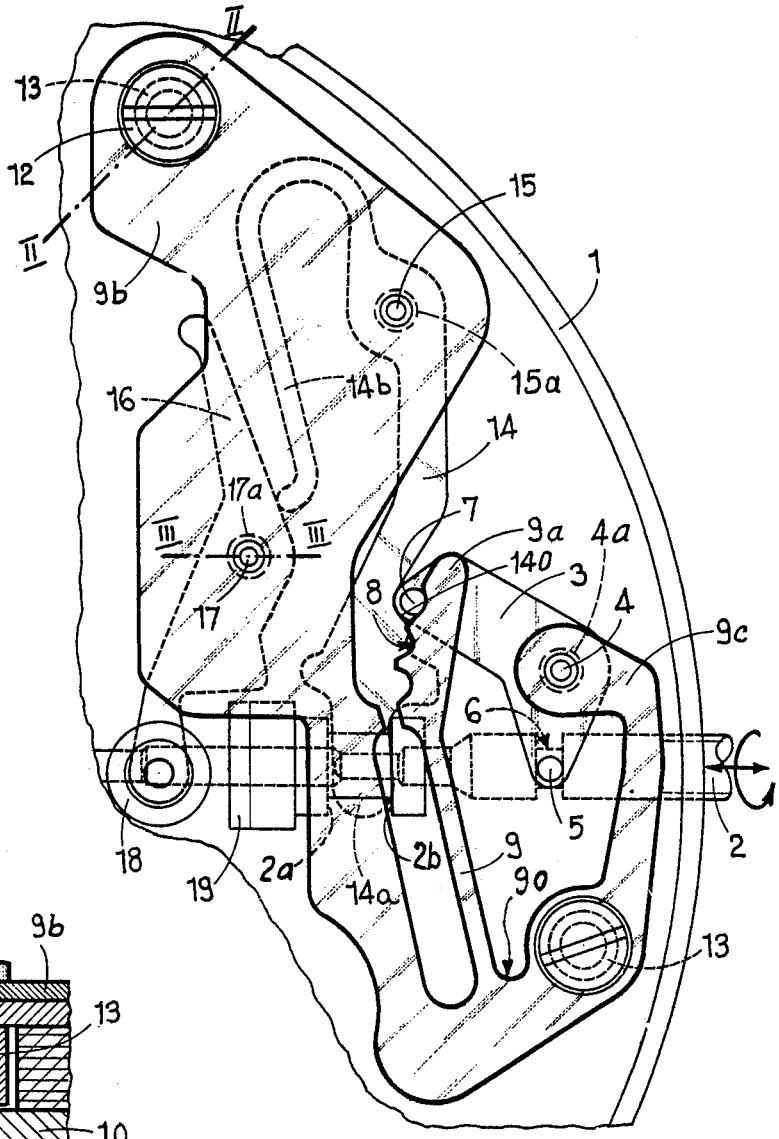
FIG. 1 is a plan view of a part of an electronic watch illustrating the setting mechanism thereof, of the type having a setting-lever, in particular for setting the timepiece to time and for altering a calendar device (data indicator)
Figure 2:
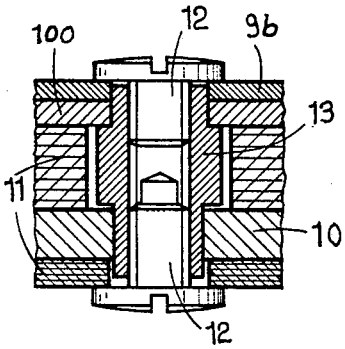
FIGS. 2 and 3 are detail views on a larger scale in section taken along lines II—II and III—III in FIG. 1 respectively.

Besides the stem 2, the setting mechanism also comprises a setting-lever 3 which is pivoted on a pivot member 4 and which carries a pin 5 engaged in a groove 6 in the stem 2. The setting lever 3 also carries a pin 7 which co-operates with one or other of a plurality of notches 8 provided in the head portion **9*a* of a setting-lever spring—or jumper spring—9. The spring 9 is one portion of a metal bridge part 90 comprising a base portion 9*b* which is fixed to a metal grid or grille 10 (FIG. 2) which is embedded in plastics material 11 forming a substrate for an electronic module (not shown) of the watch. The grid 10 moulded into the plastics material 11 forms the plate 1 of the movement of the watch. The base portion 9*b* of the spring 9 is secured in position by screws 12 engaged in posts 13 which are fitted or driven into the grid 10. A metal spacer portion 100 is interposed between the plate 1 and the base portion 9*b*. Like the grid 10, the portion 100 is moulded into the plastics material 11**.

The setting mechanism further comprises a rocking bar or rocker lever 14 which is pivoted on a pivot member 15 and an end **14*a* of which co-operates with a sliding pinion 19 (clutch wheel) carried by the stem 2. The end 14*a* is engaged between two shoulders 2*a* and 2*b* provided on the pinion 19. The end of the setting-lever 3 opposite to the pin 5 co-operates with notches provided in an edge 140 of the rocker lever 14. On the other side of the pivot member 15, rocker lever 14 includes a resilient tail arm 14*b* acting on a date altering lever 16 which is pivoted on a pivot member 17 and carries a pinion 18 for controlling a mechanism (not shown) for altering the date indicator. In certain axial positions of the stem 2, the pinion 19 carried thereby is engaged with the pinion 18, whereby the pinion 18 can be rotated by turning the stem 2**.

The assembly of the pivoting members of the setting mechanism, namely the setting-lever 3, the rocker lever 14 and the date altering lever 16, are interposed between the plate 1 and the part 90, whether being the portion **9*b* thereof, as regards the rocker lever 14 and the lever 16, or an extension portion 9*c* of the part 90, as regards the setting-lever 3**, whereby the various pivoting members are held in place.

Figure 3:
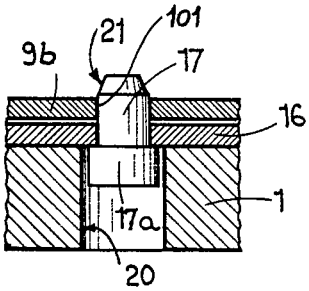

The pivot mountings of the pivoting members 3, 14 and 16 of the setting mechanism are provided in an identical manner for all those members, as illustrated in FIG. 3, in relation to the lever 16. The lever 16 carries the pivot member 17 which is fitted or driven into the lever and engages freely but without appreciable clearance in a bearing hole provided in the portion **9*b* of the part 90. Thus, the part 90 which forms the setting-lever spring 9 not only holds the pivoting members 3, 14 and 16 of the setting mechanism of the watch in position but in addition provides for pivotal movement thereof as all the pivoting members are journalled in bearings formed by holes 101 in said part 90**.

Each of the pivot members 4, 15 and 17 is of circular cross sections centered in one axis and has a head 4*a*, 15*a* and 17*a* respectively which engages with substantial diametral clearance in a corresponding hole 20 in the plate 1 (FIG. 3). Therefore, when assembling the various components, the heads of the pivot members 4, 15 and 17, to which the setting-lever 3, rocker lever 14 and lever 16 respectively will have previously been fitted, merely have to be placed in the corresponding holes of the plate 1 in order for the setting-lever, the rocker lever and the lever 16 then to be approximately in position on the plate. The part 90 forming the setting-lever spring is then put in position, with the pivot members 4, 15 and 17 engaging in the corresponding bearing holes 101 in the part 90. Engagement is facilitated by chamfering the ends of the members 4, 15 and 17, as indicated at 21 in FIG. 3. By virtue of the invention, the pivoting members of the setting mechanism are thus brought into their precise positions in which they will be held by tightening the screws 12.

By virtue of the invention, the pivoting members of the setting mechanism are not pivoted to the plate which is made of a grille or grid which is moulded into plastics material, but are pivotably cantilevered from the bridge part 90 forming the setting-lever spring, which is in one piece of metal and which is therefore better able to withstand the forces which are applied by the pivoting members to their pivot mountings.

While there are shown and described one preferred illustrative embodiment of the invention, it will be understood by those skilled in the art that other modifications may be made within the principles of the invention and the scope of the appended claims.

What is claimed is:

1. A timepiece provided with a setting mechanism, said timepiece comprising:

a base plate;

a hole in said base plate;

a pivotable member having first and second substantially parallel faces;

pivoting means attached to said pivotable member for rotation therewith, said pivoting means comprising a pivot member projecting from one of said faces and a head member projecting from the other of said faces into said hole, said head member forming an end of said pivoting means and the only portion of said pivoting means projecting into said hole, said head member further being sized to provide a substantial diametral clearance between itself and said hole, whereby said pivotable member can be only approximately positioned on said plate due to said substantial clearance which prevents said hole from serving as a bearing for said head member;

a bridge member provided with bearing means pivotably journalling said pivot member, whereby said pivoting means is pivotably supported by said bearing means and is cantilevered from said bridge member; and means for securing said bridge member to said base plate.

2. A timepiece according to claim 1, wherein said pivotable member is a setting lever, further comprising a jumper spring for cooperating with said setting lever, said jumper spring being formed integrally with said bridge member.

3. A timepiece according to claim 1, wherein said bearing means comprises a hole in said bridge member for pivotably journalling said pivot member.

4. A timepiece according to claim 3, wherein said pivot member is chamfered at its end which enters said bearing means.

5. A timepiece according to claim 1, wherein said pivoting means comprises a separate part fixed to said pivotable member, said separate part having two end portions, one of which forms said head member and the other of which forms said pivot member.

6. A timepiece according to claim 1, wherein said base plate comprises a metal framework element mounted in plastic and said bridge member is secured to said framework element.

7. A timepiece according to claim 1, wherein said bridge member is metal.

8. A method of assembling a timepiece of the type including a base plate, a pivotable member having first and second substantially parallel faces, a bridge member provided with a bearing means; and means for securing said bridge member to said base plate, said method comprising the steps of:

providing a hole in said base plate;

providing said pivotable member with pivoting means attached thereto for rotation therewith;

providing said pivoting means with a head member projecting from one of said faces, said head member forming an end of said pivoting means and being sized to provide a substantial clearance between itself and said hole, whereby said pivotable member can be only approximately positioned on said plate due to said substantial diametral clearance which prevents said hole from serving as a bearing for said head member;

providing said pivoting means with a pivot member projecting from the other of said faces, said pivoting member being sized to engage said bearing means;

inserting said head member into said hole in said base plate, so that said head member forms the only portion of said pivoting means projecting into said hole, whereby said pivotable member is approximately positioned on said plate;

placing said bridge member so that said pivot member engages said bearing means whereby said pivoting means is pivotably supported by said bearing means and is cantilevered from said bridge member; and securing said bridge member to said base plate.

* * * * *